United States Patent [19]

Ross

[11] 4,069,920

[45] Jan. 24, 1978

[54] NESTING WALL BRACKETS

[76] Inventor: Abraham Ross, 7 Felice Lane, Plainview, N.Y. 11803

[21] Appl. No.: 726,514

[22] Filed: Sept. 17, 1976

[51] Int. Cl.[2] ..... A47F 5/08

[52] U.S. Cl. ..... 211/87

[58] Field of Search ..... 211/54, 57, 59, 87, 211/189, 194; 248/221.3, 221.4; 52/593, 663, 659, DIG. 2; 273/153–160; 46/25–28

[56] References Cited

U.S. PATENT DOCUMENTS

| | | | |
|---|---|---|---|
| 507,740 | 10/1893 | Lindner | 211/175 |
| 607,812 | 7/1898 | Van Wie | 52/593 |
| 764,046 | 7/1904 | Edwards | 211/175 |
| 834,486 | 10/1906 | Noonan | 211/87 X |
| 1,972,128 | 9/1934 | Bobbroff | 273/158 |
| 2,241,490 | 5/1941 | Steinhardt | 273/160 |
| 3,154,281 | 10/1964 | Frank | 248/221.4 |
| 3,340,781 | 9/1967 | See | 52/663 X |
| 3,970,314 | 7/1976 | Mayr et al. | 273/156 |

FOREIGN PATENT DOCUMENTS

| | | | |
|---|---|---|---|
| 2,009,716 | 9/1971 | Germany | 148/150 |

*Primary Examiner*—Roy D. Frazier
*Assistant Examiner*—Terrell P. Lewis

[57] ABSTRACT

An expandable wall hanger bracket system for mounting diverse articles including a wall mounted ring having a plurality of holes about its periphery receiving support hooks in selective ones of the holes. The ring includes at least a pair of spaced arcuate slots forming sections of a continuous circle for nesting registration with the rear surface of another one of the rings. The rings are locked together by hooks received through holes in the nested portions of the rings. More or less rings may be added to the system to expand or contract the system, as desired, in a designated space.

3 Claims, 5 Drawing Figures

NESTING WALL BRACKETS

BACKGROUND OF THE INVENTION

This invention relates to a wall bracket system, and more particularly, a co-planar wall bracket system which can be expanded and contracted as needed to mount a plurality of diverse articles.

Often, space requirements vary for wall mounted brackets which hold such diverse articles as hats, scarves, ties, towels and the like. Not only does the acquisition of more of such articles necessitate the eneed for more hanging brackets, but the space in a closet may be limited and the conventional hanger bracket or rack for holding the article too large to fit such space. Accordingly, this invention provides a hanger bracket system which may be added to as the need arises to hang more articles or may be used individually or in combinations where space is limited without the addition of bulk or depth to the overall bracket system.

SUMMARY OF THE INVENTION

In accordance with the invention the bracket system includes a plurality of hanger bracket rings mounting hooks of various sizes about its periphery to receive a plurality of diverse articles. The hooks snap into square holes on the periphery of each ring. The rings include arcuate slots on their front surface which receive heating arcuate grooves on the rear surface of other ones of said rings in nesting engagement with hooks inserted through complemental holes to hold the rings together so the bracket hanging surfaces can be expanded in the same plane.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
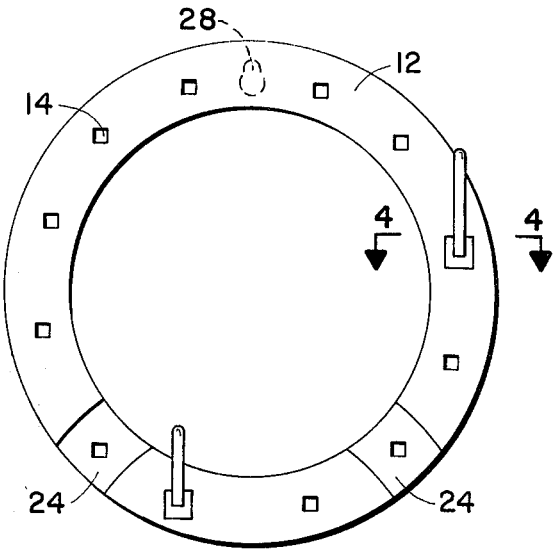
FIG. 1 is a front view in elevation of a single wall mounted hanger bracket used with the bracket system of the present invention.
Figure 2:
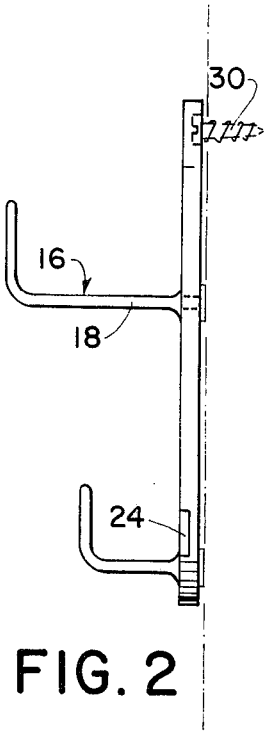
FIG. 2 is a side view in elevation of the hanger bracket of FIG. 1.
Figure 3:
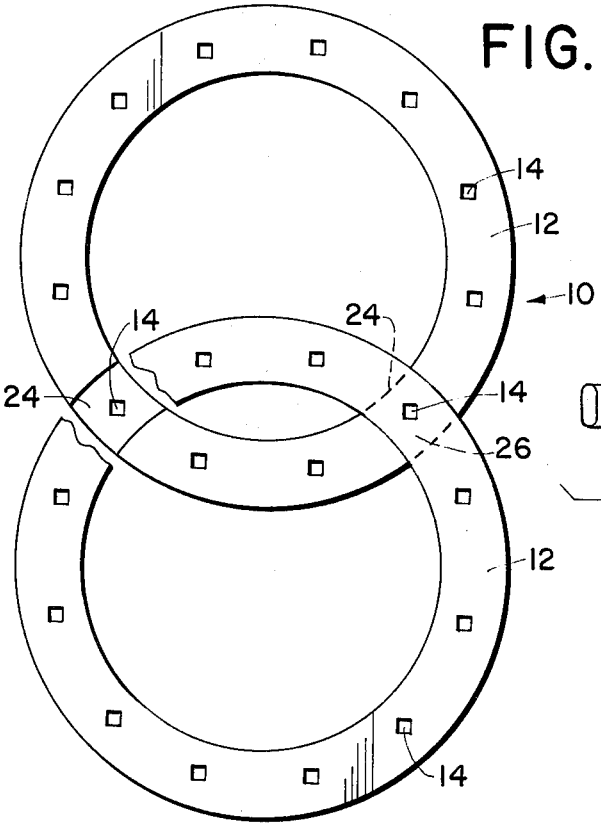
FIG. 3 is a front view in elevation of the hanger bracket of FIG. 1 nested with a second hanger bracket to expand the bracket system.

Referring now to the drawing in detail, wherein like numerals indicate like elements throughout the several views, the bracket system 10 of the present invention includes a plurality of hanger bracket rings 12, each of which has a plurality of square holes 14 about its periphery.

Figure 4:
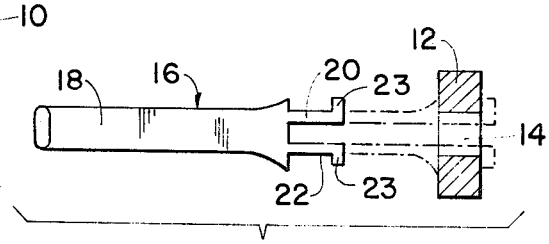
FIG. 4 is a cross-sectional view taken suhstantially along the plane indicated by line 4—4 of FIG. 1.
Figure 5:
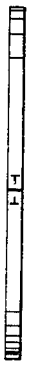
FIG. 5 is a side view in elevation of the nested hanger brackets of FIG. 3.

Each of the holes 14 is adapted to receive one of a plurality of different size hooks 16, as desired. Each hook includes a shank portion 18 terminating in a pair of resilient prongs 20, 22 including substantially flat laterally extending lip portions 23 which are snapped together and inserted through a hole 14 and released to engage the rear surface of ring 12 clamping flared shank portion to the front of ring 12, as shown in phantom lines in FIG. 4. Hooks 16 are used to hold a variety of such diverse articles as hats, towels, ties, scarves, etc.

Rings 12 include a pair of spaced arcuate slots 24 on their front surface forming together a section of a continuous circle which receive mating arcuate slots 26 on the rear surface of other ones of said rings in nesting co-planar engagement. A hook 16 is inserted through the complemental overlying holes 14 in the slots 24, 26 to hold and lock the rings together so that the bracket ring surfaces can be expanded in the same plane.

Rings 12 can be provided in the system 10 which are end units having two slots 24 and an indentation 28 on its rear surface to receive the head of a mounting screw 30, and other rings used merely for coupling purposes can be provided which have four slots 24 (two each for receiving a nested ring) to expand horizontally or vertically. Of course, single rings 12 may be provided with no slots, if desired, for individual use.

While a specific emoodiment of nesting wall brackets has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A wall bracket hanger system comprising:

a plurality of rings, each of said rings being provided with a plurality of holes therethrough spaced about its periphery; and at least one hook adapted to be selectively mounted on each of said rings to support an article, said hook including a shank portion adapted to be inserted through one of the holes on said ring, and means on said shank portion for retaining said hook on said ring in said hole, said means on the shank portion of said hook including a pair of resilient prongs having substantially flat laterally extending lip portions which are snapped together to insert said shank through said hole and then released to retain said hook on said ring, a selected one of said rings including at least a pair of spaced arcuate slots on their front surfaces forming together spaced sections of a continuous circle for receiving another one of said rings in nested relationship said arcuate slots including one of said holes in registration with a similar hole on the periphery of said nested ring to receive a hook therethrough to lock said rings together.

2. The system of claim 1, wherein said other ring includes at least a pair of arcuate slots on its rear surface in registration with the arcuate slots on said selected ones of said rings so that said nested rings occupy the same plane.

3. The system of claim 1, wherein said selected one of said rings includes means on its rear surface to mount said ring on a substantially planar surface.

* * * * *